US007971464B2

(12) United States Patent
Hachino et al.

(10) Patent No.: US 7,971,464 B2
(45) Date of Patent: Jul. 5, 2011

(54) SMALL-SIZED ELECTRONIC CASING AND METHOD OF MANUFACTURING SMALL-SIZED ELECTRONIC CASING

(75) Inventors: Motonobu Hachino, Tokyo (JP); Kenichi Ogura, Tokyo (JP)

(73) Assignee: Furukawa-Sky Aluminum Corp., Tokyo (JP)

( * ) Notice: Subject to any disclaimer, the term of this patent is extended or adjusted under 35 U.S.C. 154(b) by 1181 days.

(21) Appl. No.: 11/628,296

(22) PCT Filed: Dec. 22, 2005

(86) PCT No.: PCT/JP2005/023642

§ 371 (c)(1), (2), (4) Date: Dec. 1, 2006

(87) PCT Pub. No.: WO2006/068240

PCT Pub. Date: Jun. 29, 2006

(65) Prior Publication Data

US 2007/0236870 A1 Oct. 11, 2007

(30) Foreign Application Priority Data

Dec. 24, 2004 (JP) ..... 2004-375052

(51) Int. Cl.
*B21C 23/00* (2006.01)
*B21C 23/04* (2006.01)

(52) U.S. Cl. ..... 72/254; 72/264

(58) Field of Classification Search ..... 29/557, 29/558, 592.1; 72/254, 264, 340, 379.2, 72/253.1, 256, 268; 361/679.01
See application file for complete search history.

(56) References Cited

U.S. PATENT DOCUMENTS

| | | | | |
|---|---|---|---|---|
| 3,166,957 | A * | 1/1965 | Biesma | 72/340 |
| 4,111,328 | A | 9/1978 | Eggert et al. | 220/4 R |
| 5,649,442 | A * | 7/1997 | Yoshikawa et al. | 72/254 |

FOREIGN PATENT DOCUMENTS

| | | | |
|---|---|---|---|
| DE | 4106182 | A1 * | 9/1992 |
| JP | 39-068240 | | 12/1976 |
| JP | 04-023394 | | 1/1992 |
| JP | 05-111724 | | 5/1993 |
| JP | 08-318330 | | 12/1996 |
| JP | 2002-064283 | | 2/2002 |
| JP | 2003-290853 | | 10/2003 |
| JP | 36-27788 | | 3/2005 |
| WO | WO 2005070577 | A1 * | 8/2005 |

* cited by examiner

*Primary Examiner* — Teresa M Ekiert

(74) *Attorney, Agent, or Firm* — Bacon & Thomas, PLLC

(57) ABSTRACT

One mode of the present invention relates to a small-sized electronic casing comprising an aluminum alloy extruded shape having a hollow sectional part at least contained in a main part, wherein the extruded shape has at least either component-mounting holes or notches. Another mode of the present invention relates to a small-sized electronic casing manufacturing method that comprises a press punching process of forming at least either component-mounting holes or notches in an aluminum alloy extruded shape of a prescribed length having a hollow sectional part. The present invention may provide an aluminum alloy casing that is excellent in formability and productivity, has a smaller thickness and provides higher dimensional precision.

4 Claims, 11 Drawing Sheets

SMALL-SIZED ELECTRONIC CASING AND METHOD OF MANUFACTURING SMALL-SIZED ELECTRONIC CASING

TECHNICAL FIELD

This invention generally relates to a casing (of a type close to a skeleton) of a small-sized electronic apparatus such as a mobile phone, a mobile terminal, a transceiver, a digital camera, an electronic music reproducing apparatus, an electronic note, an electronic book, a wireless apparatus and others, and a method of manufacturing the casing, and more particularly, to a small-sized electronic casing including an aluminum alloy casing etc. for a mobile communicating apparatus, and a method of manufacturing the small-sized electronic casing.

BACKGROUND ART

A mobile communication apparatus terminal such as a mobile phone of a latest type increases not only an occupancy ratio of a liquid crystal display part to a terminal casing, but also the number of components mounted to the casing, as functions available as a mobile communication means further increase. Thus, a weight reduction, that is, a thickness reduction is required for the casing having greater weight of a mass that occupies in the whole terminal.

A plastic injection-molded product excellent in mass productivity is used for the casings of mobile phones that are on the market in large quantities among mobile communication apparatuses, in which case, however, various problems exist.

One of the problems is that the plastic material is inferior in mechanical properties such as tensile strength, modulus of elasticity and impact resistance as compared with a metal material, and besides, a residual stress at the time of molding causes a plastic molded product of a small thickness to be deformed so that degradations in thermal reliability occur, resulting in a limitation in the thickness reduction of the casing comprised of the plastic molded product. While use of fiber reinforced plastic (FRP) permits the mechanical properties and/or thermal reliability to be improved to some extent, it is difficult to manufacture a practically serviceable casing having a thickness of 1.5 mm or less using the fiber reinforced plastic.

Another problem is that the casing comprised of the plastic molded product fails to shield electromagnetic waves having undesirable effects on human bodies after leakage from a circuit of internally packaged electronic components, resulting in a need for electromagnetic wave shielding works by giving surface treatments etc. in the manner of plating such as ion plating and electroless plating with copper and nickel etc.

In view of the above backgrounds, a casing obtained by giving forging to an aluminum alloy blank (a rolled sheet) has been suggested in recent years (See Patent document 1 described later). Specifically, an aluminum alloy has a higher density of 2.7 g/cm$^3$ as compared with 0.8 to 1.4 g/cm$^3$ for the plastic material and is also about 1.7 times the tensile strength and about 6 times the modulus of elasticity in comparison with the plastic material. Thus, the aluminum alloy ensures that a specific strength (tensile strength/density) and a specific rigidity (modulus of elasticity/density) are relatively high, permitting contribution toward the thickness reduction of the casing.

The casing involving use of the aluminum alloy is effective in absorbing or reflecting the electromagnetic waves, and thus provides a higher electromagnetic wave shielding efficiency as compared with a casing obtained by giving plating to the plastic material. In the present days with a tendency to call for more strict regulations for the control of electromagnetic troubles, an advantage that the casing itself has the electromagnetic shielding efficiency is by no means negligible.

Further, the aluminum alloy casing has other advantages that anodic oxide coating may provide an impression of higher grade for the casing, and besides, is excellent in recycling efficiency.

However, the casing obtained by giving forging to the aluminum alloy rolled sheet gives rise to problems such as degradations in dimensional precision and fluctuations in surface form and properties. That is, in the case of hot forging, an anisotropy of a material strength depending on a metal forging flow direction and the dimensional precision arises. In the case of cold forging, though somewhat improved dimensional precision is provided, there are problems that formability and dimensional precision are inferior as compared with punching and cutting works, and a surface form and properties after forging are anything but desirable, in addition to a reduction in degree of freedom in selection of forms.

Patent document 1: Japanese Patent Laid-open No. 2002-64283

DISCLOSURE OF THE INVENTION

Problems to be Solved by the Invention

An object of the present invention is to provide, in relation to a casing involving use of an aluminum alloy material, a small-sized electronic casing such as a mobile communication apparatus casing etc. that has a smaller thickness, is excellent in formability, electromagnetic wave shielding efficiency and recycling efficiency, and provides not only a higher degree of freedom in selection of forms, but also more desirable surface form and properties (design properties).

The electronic casing in the present invention is not limited to a casing for a mobile communication apparatus, and an application to any small-sized electronic casing supposed to be of a type permitting use of a shape having a hollow section is possible.

Another object of the present invention is to provide a manufacturing method that is applicable to manufacture, smoothly with higher productivity and dimensional precision, the small-sized electronic casing such as the mobile communication apparatus casing adaptable to meet the above object.

Means for Solving the Problems

To attain the above objects, a small-sized electronic casing according to the present invention comprises, as most principal features, an aluminum alloy extruded shape having a hollow sectional part at least contained in a main part, wherein the extruded shape has at least either component-mounting holes or notches.

The holes and/or notches are preferably formed by means of press punching.

It is to be noted that a term of "component-mounting" is herein supposed to include mounting applicable to effect mounting of components, in addition to that adapted to provide direct mounting of the components to hole or notch portions in engagement or fitting of the components with the holes or notches.

To attain the above objects, a first method of manufacturing a small-sized electronic casing according to the present invention comprises, as most principal features, a press punching process of forming at least either component-mounting holes or notches in an aluminum alloy extruded shape of a prescribed length having a hollow sectional part.

To attain the above objects, a second method of manufacturing a small-sized electronic casing according to the present invention is characterized in that, as most principal features, a machining process excepting surface finishing of the small-sized electronic casing involving use of an aluminum alloy extruded shape of a prescribed length having a hollow sectional shape contains only a press punching process of forming either component-mounting holes or notches in the extruded shape or a press punching process of forming both the component-mounting holes and notches.

Effects of the Invention

According to the small-sized electronic casing of the present invention, this casing is comprised of the aluminum alloy extruded shape having the hollow sectional part at least contained in the main part, and the extruded shape has at least either the component-mounting holes or notches, thereby providing a casing that has a smaller thickness, is excellent in formability, electromagnetic wave shielding efficiency and recycling efficiency, and provides not only a higher degree of freedom in selection of forms, but also more desirable surface form and properties (design properties).

According to the first method of manufacturing the small-sized electronic casing of the present invention, this method is to form the component-mounting holes and/or notches by press punching adapted to form at least either the component-mounting holes or notches in the aluminum alloy extruded shape of the prescribed length having the hollow sectional part, permitting the small-sized electronic casing according to the present invention to be manufactured smoothly with higher productivity and dimensional precision.

According to the second method of manufacturing the small-sized electronic casing of the present invention, the machining process excepting the surface finishing contains only the press punching process of forming either the component-mounting holes or notches in the extruded shape or the press punching process of forming both the component-mounting holes and notches, in which case, a need for other machining works excepting the surface finishing is eliminated, permitting productivity to be further improved as compared with the first manufacturing method.

According to the method of the present invention, the press punching is taken to form the component-mounting holes or notches in the extruded shape, leading to higher productivity, in addition to adaptability to give machining to a larger number of portions at the same time without producing chips nor causing damages to the extruded shape, as compared with cutting works.

Further, the method in either case provides such effects that the deformation supposed to occur at the time of press punching against the extruded shape may be minimized by placing a machined material under sufficient constraint in the process of press punching.

It is to be noted that the present invention ensures that, with the machining substantially or completely saved, control of dimensional variations in the process of working is provided, permitting contribution toward use of the hollow-like aluminum alloy extruded shape for the small-sized electronic casing.

BEST MODE FOR CARRYING OUT THE INVENTION

An embodiment relating to an application of a small-sized electronic casing and its manufacturing method according to the present invention to a mobile phone casing available as one typical small-sized electronic casing is now described with reference to drawings.

Figure 1:
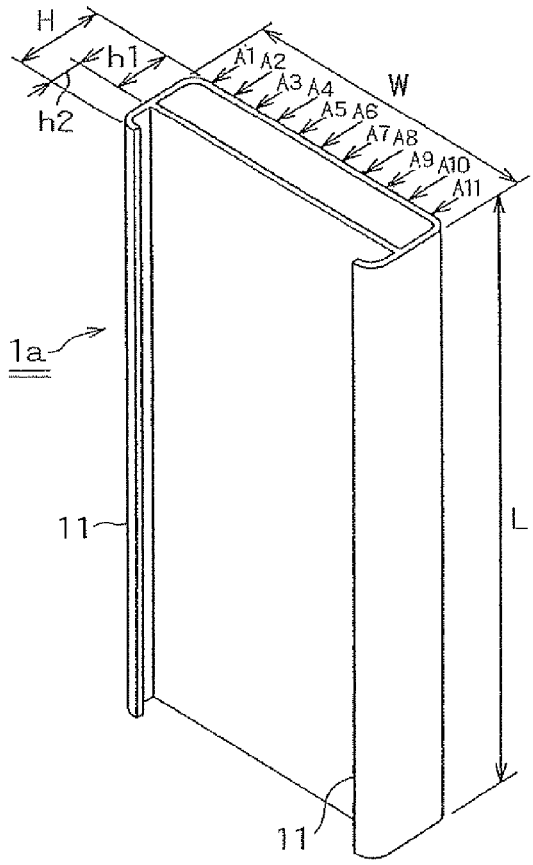
FIG. 1 is a perspective view showing one form of an extruded shape used for a mobile communication apparatus as one typical small-sized electronic casing according to the present invention.

FIG. 1 is a perspective view of an extruded shape 1*a* adapted to form a main part of an integrated mobile phone casing (of a type that requires no connection of two casing units through a hinge or slide mechanism, for instance). The illustrated extruded shape 1*a* is composed of a wholly-flat approximately-rectangular hollow sectional part 10 and ribs 11 formed as integral parts of the opposite sides of the hollow sectional part 10. The ribs 11 are so curved in a circular arc that their tip end portions face each other.

It is to be noted that a term of "flat" is herein defined as a sectional form having two parallel or approximately parallel longer sides. Thus, a flat form is assumed to include various forms such as rectangles, trapezoids and rectangular or trapezoidal forms whose corner parts have R of a prescribed size, and the forms such as those shown in FIGS. 11(*c*) to 11(*h*) described later are all included, for instance.

While a size of the extruded shape 1*a* is selected depending on a mobile phone design, the embodiment shown in FIG. 1 specifies a length L as 100 mm, a width W as 50 mm, a hollow sectional part height h1 as 10 mm, a rib height h2 as 6 mm, a hollow sectional part thickness as 0.8 mm, and a rib thickness as 0.6 mm, and ensures that the dimensional precision meets a JIS special class.

The extruded shape 1*a* is a material obtained by cutting a long extruded shape to the above length, in which case, cutting of the long extruded shape as described the above is practicable through a straightening process by means of roll straightening or others after extrusion is finished. However, this embodiment leaves out the straightening process because of an application of extrusion of high precision.

part contained in a flat part including no ribs of the hollow sectional part of the casing were specified as A1 and A11 to assign, in order, A1, . . . , and A11 to measurement points obtained by dividing the rectilinear part extending from A1 to A11 into ten equal parts, each maximum of deviations of the measurement points A2 to A10 from a true straight line was given in terms of a straightness. When a position adapted to give the maximum was in misalignment with each measurement point, a value of the measurement point next to a point indicative of the maximum given at the misalignment position was displayed after being rewritten into the maximum. In the case of the extrusion with the above highly precise dies, the straightness was so given as to satisfy 0.15 mm or less per 40 mm of a rectilinear part length. Conversely, the straightness in the case of the extruded shapes resulting from the extrusion with the normal dies was about 0.5 to 1 mm per 40 mm of the rectilinear part length.

TABLE 1

| MATERIAL | | DIMENSIONAL MEASUREMENT POINTS | | | | | | | | | | | STRAIGHTNESS |
|---|---|---|---|---|---|---|---|---|---|---|---|---|---|
| | | A1 | A2 | A3 | A4 | A5 | A6 | A7 | A8 | A9 | A10 | A11 | |
| HIGHLY PRECISE EXTRUDED MATERIAL | HIGHLY PRECISE EXTRUDED MATERIAL A | 0.00 | 0.02 | 0.05 | 0.06 | 0.08 | 0.10 | 0.08 | 0.06 | 0.05 | 0.02 | 0.00 | 0.10 mm |
| | HIGHLY PRECISE EXTRUDED MATERIAL B | 0.00 | 0.05 | 0.08 | 0.11 | 0.13 | 0.15 | 0.13 | 0.12 | 0.08 | 0.06 | 0.00 | 0.15 mm |
| | HIGHLY PRECISE EXTRUDED MATERIAL A + PUNCHING | 0.00 | 0.03 | 0.07 | 0.09 | 0.12 | 0.14 | 0.13 | 0.10. | 0.07 | 0.03 | 0.00 | 0.14 mm |
| | HIGHLY PRECISE EXTRUDED MATERIAL B + PUNCHING | 0.00 | 0.08 | 0.12 | 0.17 | 0.19 | 0.22 | 0.19 | 0.16 | 0.12 | 0.07 | 0.00 | 0.22 mm |
| NORMAL EXTRUDED MATERIAL | NORMAL EXTRUDED | 0.00 | 0.08 | 0.23 | 0.35 | 0.45 | 0.50 | 0.45 | 0.36 | 0.24 | 0.08 | 0.00 | 0.5 mm |
| | MATERIAL | 0.00 | 0.23 | 0.45 | 0.83 | 0.93 | 0.97 | 0.94 | 0.83 | 0.46 | 0.23 | 0.00 | 0.97 mm |
| | NORMAL EXTRUDED | 0.00 | 0.13 | 0.36 | 0.52 | 0.63 | 0.74 | 0.65 | 0.54 | 0.35 | 0.13 | 0.00 | 0.74 mm |
| | MATERIAL + PUNCHING | 0.00 | 0.35 | 0.54 | 0.88 | 1.05 | 1.23 | 1.11 | 0.88 | 0.54 | 0.34 | 0.00 | 1.23 mm |

The following is one illustration of extruding conditions and materials of the extruded shape.

Material: JIS6063 alloy (JIS 3003 or 6061 alloy is also available)

Required billet: 145 ϕ×400 mm

Homogenizing treatment: keeping at 560° C. for 4 hours (a temperature-up rate: 40° C./hr)

Extrusion rate: 15 to 30 m/min

Extrusion temperature: 460 to 530° C.

Others:

Highly precise dies were used which provide a bearing finish as Rmax of 2 μm and 5 μm (normally, 20 μm) by taking measures such as a measure of heightening a male-type bridge rigidity, with a dies thickness increased for prevention of dies bending.

The extruded shape resulting from extrusion with the extruding dies adapted to provide Rmax of 2 μm was specified as a highly precise extruded material A, and the extruded shape resulting from extrusion with the extruding dies adapted to provide Rmax of 5 μm was specified as a highly precise extruded material B. In addition, extrusion with normal extruding dies (which will be hereinafter referred to as "a normal extruding manner") was effected for comparison, and the resultant extruded shape was specified as a normal extruded material.

After the extrusion and straightening, the extruded materials were cut to the prescribed length and were followed by measurements of their dimensional precision obtained before and after press punching described later to these extruded materials, and Table 1 gives results of the above measurements. A comparison of the dimensional precision was made in such a manner that, when the opposite ends of a rectilinear In the case of the extrusion in the normal extruding manner, the straightness required for mounting of components is so inferior as to cause an insufficiency of straightness for use of the extruded shape for the mobile phone casing, so that straightening of extruded shape sectional dimensions by roll forming etc. becomes a necessity. As long as a result of the straightening of the extruded shape dimensions is that the straightness before the press punching reaches 0.30 mm or less per 40 mm of the rectilinear part length, the use of the extruded shape for the mobile phone casing is made realizable. As described the above, the roll forming or the like enables the extruded shape (or the extruded shape having the straightness of 0.50 mm in Table 1, for instance) obtained in the normal extruding manner to be so straightened as to fall in a dimensional range requiring that the above straightness be 0.30 mm or less, permitting contributions toward the use of the extruded shape for the casing according to the present invention.

While it is preferable that the straightening of the extruded shape sectional form is given to the long extruded shape as described the above because of its advantage of being more excellent in productivity, use of proper straightening means may also provide the straightening after cutting to a product length and/or forming into a final product shape.

The above straightening means may be by press straightening etc., in addition to the roll forming. Particularly, portions adapted to mount components such as an image display device and closely-arranged number-displayed pushbuttons are supposed to be specified as targets for the straightening, in which case, the dimensional precision of these component-mounting portions requires that the straightness after the press punching be 0.30 mm or less, preferably, 0.25 mm or less per 40 mm of the rectilinear part length.

The extruded shape 1*a* has a large number of component-mounting holes and notches, and, while the number, the arrangement, the form and the size etc. of these holes and notches are determined in correspondence with the mobile phone design, one embodiment relating to the above is now described.

Figure 2:
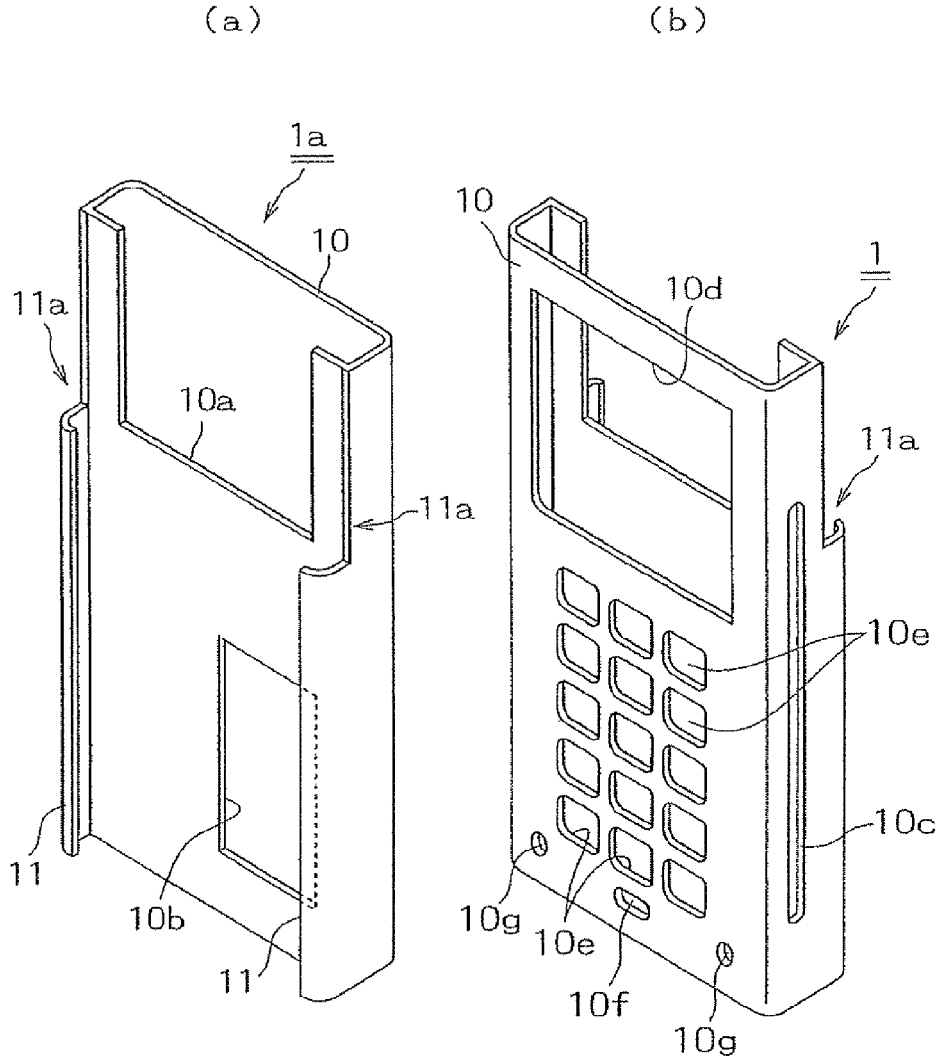
FIG. 2 is a perspective view of a workpiece obtained by giving press punching to the extruded shape in FIG. 1, wherein FIG. 2(*a*) is a perspective view of a state of the workpiece having press-punched component-mounting notches and hole in ribs of the shape and a surface (a back surface) having the ribs, and FIG. 2(*b*) is a perspective view of a state where press punching for formation of component-mounting holes is given to one side surface and the back surface of the shape to provide the workpiece in the form of the casing.

As shown in FIG. 2(*a*), the extruded shape 1*a* has the opposite ribs 11 having, at each one end, a component-mounting notch 11*a* of a prescribed length, and the hollow sectional part 10 having, at one surface including the ribs 11 (this surface is hereinafter referred to as "a back surface", and a surface opposite to the back surface is referred to as "a front surface" for the convenience of explanations), a component-mounting notch 10*a* and a component-mounting hole 10*b*, respectively.

As shown in FIG. 2(*b*), the hollow sectional part 10*a* is formed in the shape having one side surface having a component-mounting hole 10*c*, and the front surface having a square large-sized hole 10*d* adapted to provide engagement-mannered mounting of a display part for images etc., several holes 10*e* adapted to provide fitting-mannered mounting of input and operation switches, and other small-sized holes 10*f*, 10*g*, 10*g*, so that the casing 1 as shown in FIG. 2(*a*) is manufactured.

The casing 1 manufactured as described the above is given shot blasting or hairline treatment, and is followed by surface finishing in the manner of anodic oxide coating, painting and plating etc.

The extruded shape has, as its characteristics, the same sectional form in a longitudinal direction, so that the casing 1 obtained by punching the extruded shape as shown in FIG. 2(*b*) also requires, as a matter of course, that other members be inserted into upper and lower ends of the casing to bring the casing to completion. In this case, it is allowable to provide a complete casing by, after properly inserting (or fitting) members available in conformity with shape end sections into the shape ends specified as the target ends for insertion of the other members, fixing the members to the shape ends by bonding or screwing etc. The members fitted into the shape ends are not limited to an aluminum material, and a resin etc. is also available. The holes such as the holes 10*g* shown in FIG. 2(*b*) are useful as mounting holes, for instance.

Figure 3:
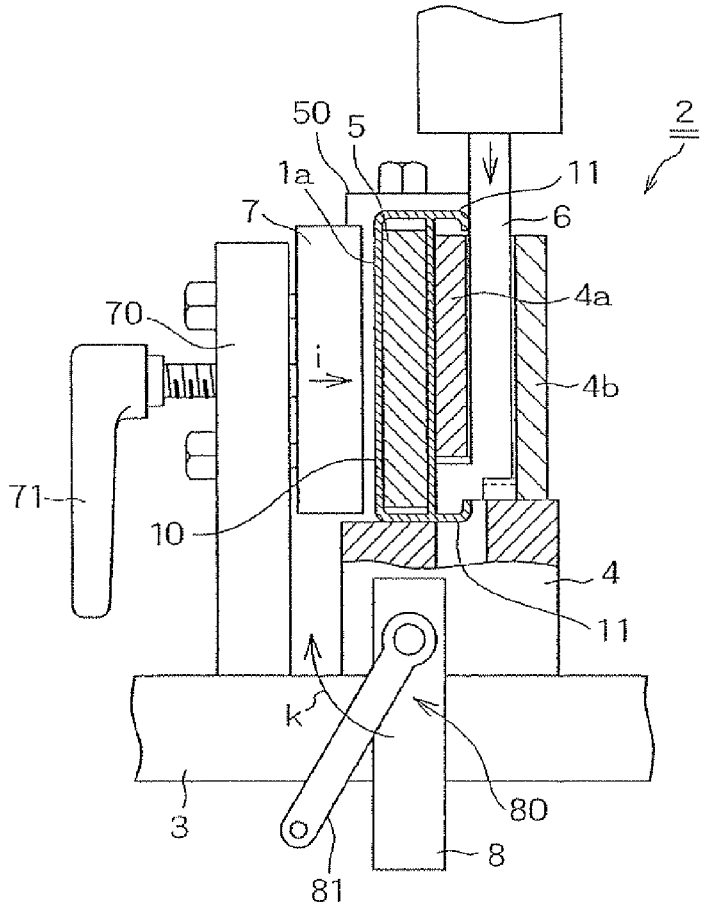
FIG. 3 is a partially cutaway view of schematic front elevation of a press punching apparatus adapted to form the notch in each rib of the extruded shape in FIG. 1.
Figure 4:
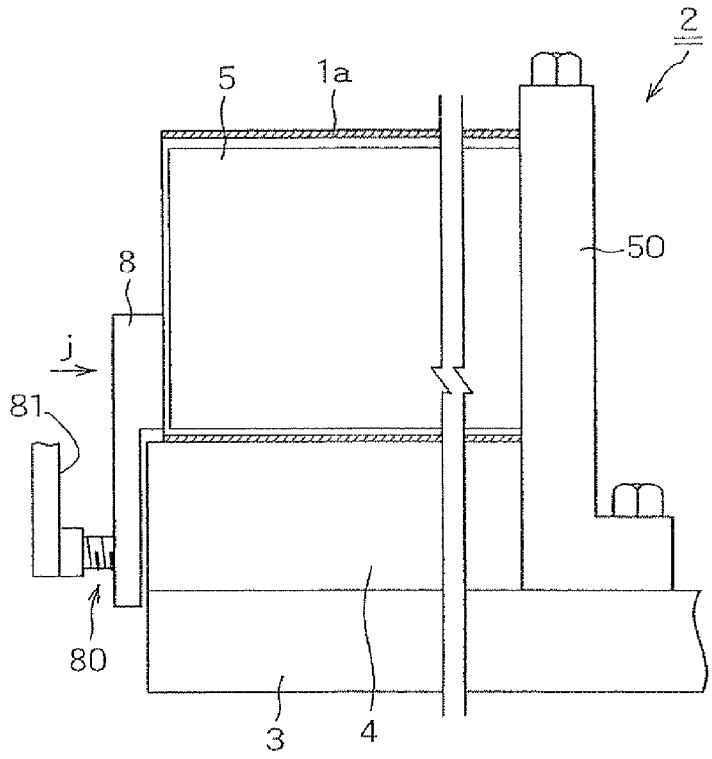
FIG. 4 is a partially cutaway view of schematic side elevation of the press punching apparatus in FIG. 3.

As will be described in the following, the above-mentioned component-mounting holes and notches are preferably formed by means of press punching. FIG. 3 is a partially cutaway view in front elevation of a press punching apparatus 2 adapted to form the notch 11*a* of FIG. 2(*a*) in each rib 11 of the extruded shape 1*a*. FIG. 4 is a partially cutaway view in side elevation of the apparatus 2 shown in FIG. 3.

Reference numeral 3 denotes a table used for installation of the press punching apparatus 2, and a dies 4 is mounted on the table 3. Reference numeral 5 denotes a core adapted to provide setting of the extruded shape 1*a* so that a width direction of the hollow sectional part 10 assumes a vertical. The core 5 has one end fixed to a mounting block 50 (See FIG. 4) mounted vertically on the table 3, with the core placed in parallel to an upper surface of the dies 4 through one side wall of the hollow sectional part 10 of the set-up extruded shape 1*a*. The core 5 is designed to be slightly smaller in length (by about 1 to 3 mm) than the extruded shape 1*a* as shown in FIG. 4.

Reference numeral 6 denotes a punch placed in a suspended position in close vicinity to the upper-positional rib 11 of the extruded shape 1*a*. A lower end as a working-side end of the punch is in the form of a hook-like end to get near to or make contact with the back surface of the extruded shape 1*a* at the inside of the lower-positional rib 11.

Reference numeral 7 denotes a press member placed in parallel to the front surface of the extruded shape 1*a* over the whole length of the extruded shape. The press member 7 is so operated by a screw jack-type pressing apparatus 70 mounted on the table 3 as to make a horizontal motion in a direction of an arrow i (see FIG. 3) for pressing the extruded shape 1*a* from its front direction against the core 5. Reference numeral 8 denotes a different press member installed to a this-side end face of the dies 4 (See FIG. 3). The press member 8 is so operated by a screw jack-type pressing apparatus 80 as to, after clockwise turning in a 180-degree arc as indicated by an arrow k from its suspended position in FIG. 3, make a motion in a direction of an arrow j in FIG. 4 for pressing the extruded shape 1*a* against the mounting block 50.

Reference numeral 4*a* denotes another dies located between the upper-positional rib 11 of the extruded shape 1*a* and the hook-like lower end of the punch 6. The dies 4*a* is fixed to the dies 4 in close vicinity to the back surface of the extruded shape 1*a* and a vertical part of the punch 6. Reference numeral 4*b* denotes a guide member installed to an upper surface side of the dies 4 in close vicinity to the punch 6 and in parallel to the dies 4*a*.

After setting the extruded shape 1*a* on the core 5 of the press punching apparatus 2 with the core 5 placed in an inserted position, the pressing apparatus 70 is activated by a handle 71 to move the press member 7 forward in the direction of the arrow i for pressing the shape 1*a* against the core 5, causing the above shape 1*a* to be placed under constraint in a direction orthogonal to two directions, i.e., a longitudinal direction of the shape and a punching direction.

Then, the press member 8 is turned in the 180-degree arc as indicated by the arrow k in FIG. 3 up to its stand-up position, and the pressing apparatus 80 is activated through the operation of a handle 81 to press the extruded shape 1*a* against the mounting block 50 by the press member 8, causing the above shape 1*a* to be placed under constraint in the longitudinal direction.

With the shape 1*a* placed under constraint as described the above, the punch 6 is moved downward to form the notch 11*a* of FIG. 2(*a*) in the lower-positional rib 11 by giving punching to the end of the lower-positional rib 11.

To form the notch 11*a* in the other rib 11 by punching, a punching apparatus is used, in which the core 5 is arranged in a direction opposite to that shown in FIG. 3, and when setting of the shape 1*a* on the core 5 with the ribs 11, 11 turned to the left in FIG. 3 is provided, each part is in so arrangement as to have a correspondence with the set-up shape 1*a* as described the above.

A casing manufacturing method including a machining process involving use of the press punching apparatus 2 is correspondent to a method of manufacturing the small-sized electronic casing according to claim 17.

Figure 5:
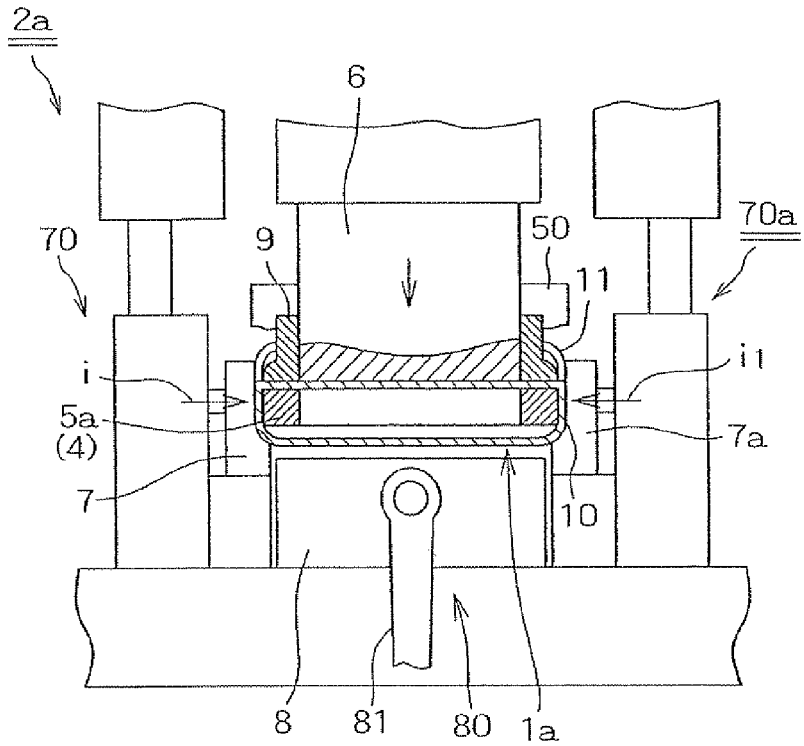
FIG. 5 is a partially cutaway view of schematic front elevation of a press punching apparatus adapted to form the component-mounting hole and notches in the back surface of the extruded shape in FIG. 1.

FIG. 5 is a partly cutaway view of front elevation of a press punching apparatus 2*a* adapted to form the notch 10*a* and the hole 10*b* of FIG. 2(*a*) in the back surface of the extruded shape 1*a*. Constitutional parts different from those of the press punching apparatus 2 are only described in the following, without giving any description relating to the same constitutional parts as those of the press punching apparatus 2.

A core 5*a* also serves as the dies 4 and is fixed to the mounting block 50 so that a width direction of the core assumes a horizontal. The core 5*a* is adapted to provide setting of the extruded shape 1*a*, with the hollow sectional part 10 placed so that its back surface is turned up.

Press members 7, 7*a* are so mounted in parallel on the table 3 as to be in close vicinity to the opposite sides of the core 5*a*. The press members 7, 7*a* are moved uniformly in directions of arrows i and i1 by pressing apparatuses 70, 70*a* adapted to convert a vertical (downward) press force into a horizontal force, causing the shape 1*a* to be placed under constraint in the direction orthogonal to two directions, i.e., the longitudinal direction of the shape 1*a* and the punching direction, with the above shape 1*a* held from both sides.

The different press member 8 is so mounted on the table as to provide its upward motion up to the level of the shape 1*a* in advance of a pressing operation.

Reference numeral 9 denotes a stripper slightly operated to make a slightly downward motion in synchronization with the downward motion of the punch 6 into contact with the shape 1*a* slightly earlier than punching with the punch 6 for pressing the back surface of the hollow sectional part 10 against the core 5*a* also serving as the dies 4.

After setting the shape 1*a* on the core 5*a* of the press punching apparatus 2*a* like an illustrated state, the press member 8 is moved upward to the level of the shape 1*a*, and the pressing apparatus 80 is activated through the operation of the handle 81 to press the shape 1*a* against the mounting block 50, causing the above shape 1*a* to be placed under constraint in the longitudinal direction. Then, immediately after the pressing apparatuses 70, 70*a* are moved downward in synchronization with the punch 6 so that the press members 7, 7*a* are operated to place the shape 1*a* under constraint in the direction orthogonal to the two directions, i.e., the longitudinal direction and the punching direction, the notch 10*a* and the hole 10*b* of FIG. 2(*a*) are formed in the back surface of the shape 1*a* by punching with the punch 6.

It is to be noted that depending on the size, the number and other requirements of the holes and notches to be formed, it is allowable to effect the punching with the shape 1*a* placed under constraint only in the longitudinal direction of the shape or in only the direction orthogonal to the two directions, i.e., the longitudinal direction of the shape and the punching direction.

The casing manufacturing method including the machining process involving use of the press punching apparatus 2*a* is one correspondent form of the method of manufacturing the small-sized electronic casing according to claim 13.

Figure 6:
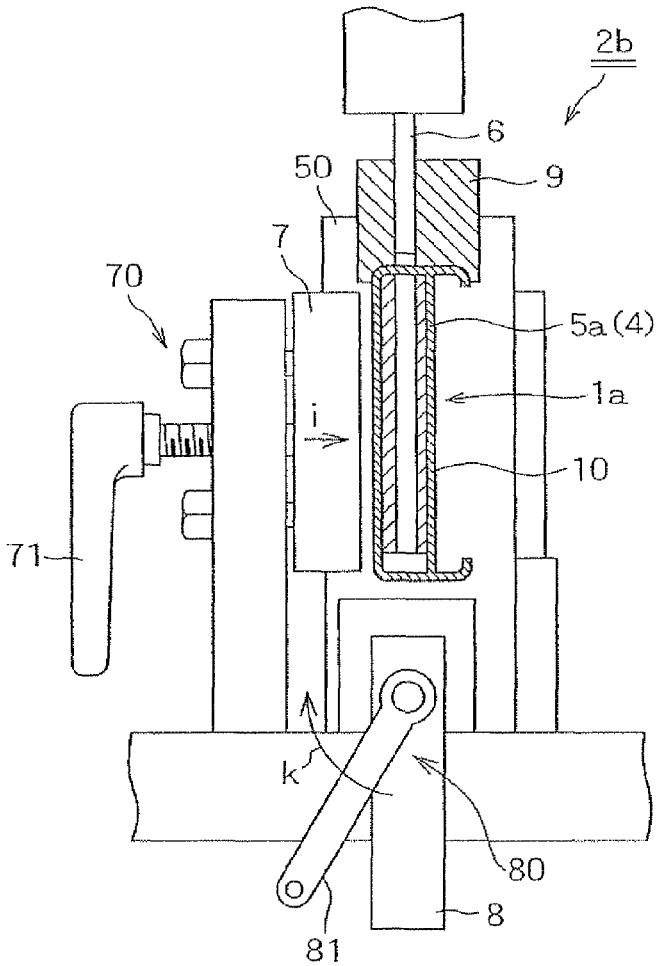
FIG. 6 is a partially cutaway view of schematic front elevation of a press punching apparatus adapted to form a component-mounting hole in the side surface of the extruded shape in FIG. 1.

FIG. 6 is a partially broken-away view of section of a press punching apparatus 2*b* adapted to form the hole 10*c* of FIG. 2(*b*) in the side surface of the extruded shape 1*a*.

The core 5*a* also serving as the dies 4 is fixed to the mounting block 50 so that the width direction of the core assumes a vertical. The core 5*a* is adapted to provide setting of the extruded shape 1*a*, with the hollow sectional part 10 placed so that its back surface is turned to the right in the drawing.

The press members 7, 8 are mounted on the table 3 to perform the same operation as that of the press members in the punching apparatus shown in FIG. 2.

The stripper 9 is so configured as to make a downward motion in synchronization with the punch 6, as being slightly in advance of the punch 6, into contact with the shape 1*a* slightly earlier than the punching with the punch 6 for pressing the surface to be machined of the shape 1*a* against the core 5*a*.

After setting the extruded shape 1*a* on the core 5*a* of the press punching apparatus 2*b* like the illustrated state, the press member 8 is turned in the 180-degree arc as indicated by the arrow k up to the level of the shape 1*a*, and the pressing apparatus 70 is activated through the operation of the handle 71 to move the press member 7 forward in the direction of the arrow i for pressing the shape 1*a* against the core 5, causing the above shape 1*a* to be placed under constraint in the direction orthogonal to the longitudinal direction of the shape and the punching direction. Further, the pressing apparatus 80 is activated through the operation of the handle 81 to press the shape 1*a* against the mounting block 50, causing the above shape to be placed under constraint in the longitudinal direction.

Then, the punch 6 is moved downward in synchronization with the stripper 9, so that the component-mounting hole 10*c* of FIG. 2(*b*) is formed in the side surface of the shape 1*a* by punching.

It is to be noted that depending on the size, the number and other requirements of the holes and notches to be formed, it is also allowable to effect the punching with the shape 1*a* placed under constraint only in the longitudinal direction of the shape or only in the direction orthogonal to the two directions, i.e., the longitudinal direction of the shape and the punching direction. However, the punching with the shape placed under constraint only in the direction orthogonal to the longitudinal direction and the punching direction is normally required.

The casing manufacturing method including the machining process involving use of the press punching apparatus 2*b* is one correspondent form of the method of manufacturing the small-sized electronic casing according to claim 13.

It is allowable to, by preliminarily forming, in dispersed positions, location holes in the surface to be machined of the shape 1*a* before formation of the component-mounting holes and notches in the shape 1*a* by punching, machine the component-mounting holes and notches by taking advantage of these location holes.

This type of machining method has advantages of providing easy alignment of target positions for formation of the component-mounting holes and notches of the shape 1*a* with the stripper holes when the above component-mounting holes and notches are in dense arrangement within a prescribed area, and of being easy to so constrain the shape 1*a* as to hold it in position at the time of punching.

One embodiment relating to the above method is described in the following.

Before formation of each of the holes 10*d*, 10*e* and 10*f* in the surface to be machined contained in the front surface of the shape 1*a* in FIG. 2(*b*), two location holes 10*g* and four location holes 10*h* are formed, in well-balanced dispersed positions, in the surface to be machined. While the two location holes 10*g* are available as the component-mounting holes, the other four location holes 10*h* are holes used only for hole location, and need to be formed in positions contained in a target area for formation of the display part-mounting square large-sized hole 10*d*.

While these location holes 10*g*, 10*h* may be formed by means of drilling etc., press punching is preferably taken to form these location holes. To form the location holes 10*g*, 10*h* by press punching, a press punching apparatus may be used, in which the core 5*a* in the press punching apparatus 2*a* of FIG. 5 is modified in conformity with the target positions for formation of the location holes 10*g*, 10*h* and these hole sizes, and the stripper and the punch are also modified to be suitable for the above core.

Figure 7:
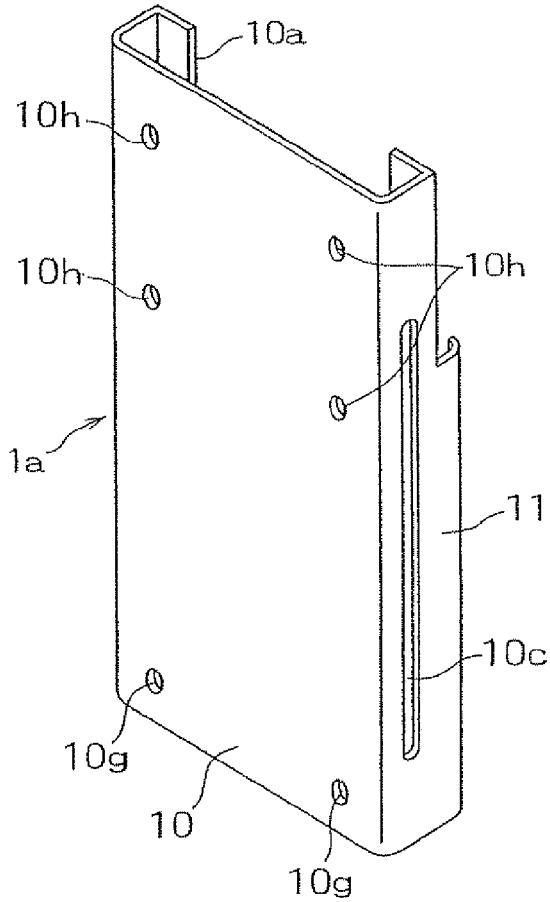
FIG. 7 is a perspective view of a state of press-punched location holes in a front surface of the extruded shape in FIG. 2(*a*)
Figure 8:
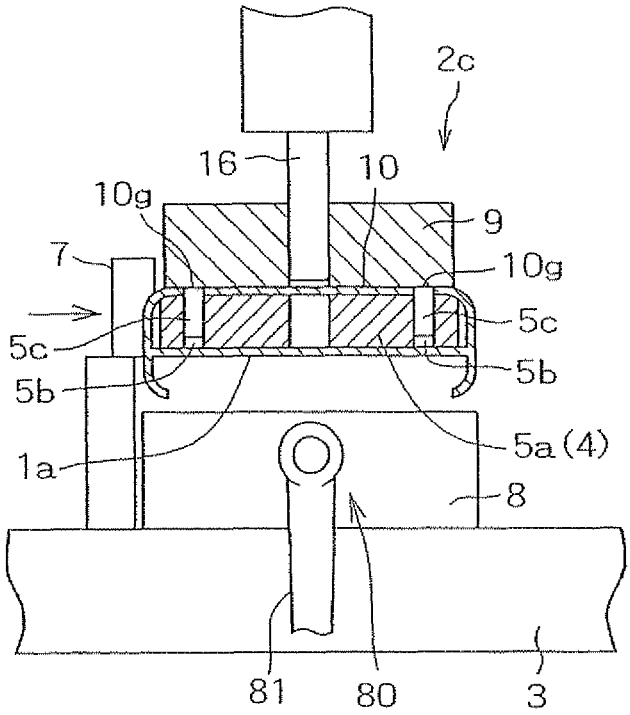
FIG. 8 is a partially cutaway view of schematic front elevation of a press punching apparatus adapted to form a component-mounting hole in the front surface of the extruded shape in FIG. 7 by taking advantage of the location holes.
Figure 9:
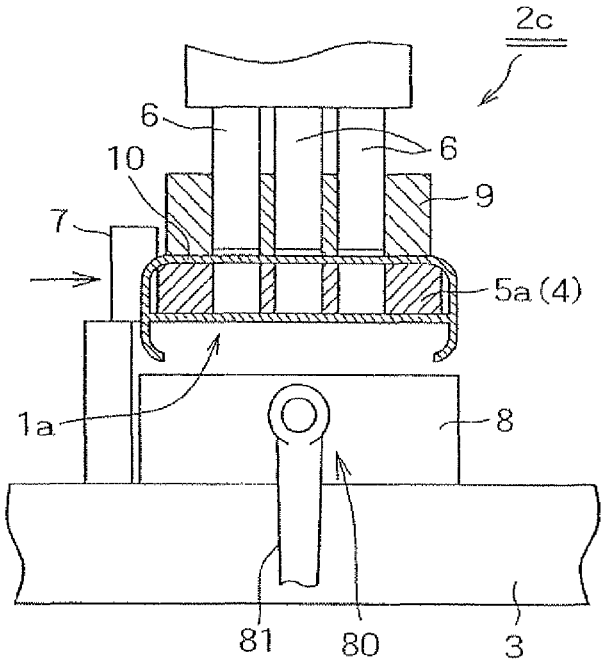
FIG. 9 is a partially cutaway view of schematic front elevation of a press punching apparatus adapted to form other component-mounting holes in the front surface of the extruded shape in FIG. 7 by taking advantage of the location holes.

Firstly, the several component-mounting holes 10*e* and the component-mounting small-sized hole 10*f* are formed using a press punching apparatus 2*c* shown in FIGS. 8 and 9 by taking advantage of the location holes 10*g*, 10*h* provided as shown in FIG. 7.

FIG. 8 is a partially cutaway view of front elevation of an apparatus portion adapted to form the component-mounting small-sized hole 10*g*. FIG. 9 is a partially cutaway view of front elevation of an apparatus portion adapted to form the several holes 10*e* for mounting of input and operation switches.

Referring to FIG. 8, while two location holes 10*g* are shown, there are not shown other four location holes 10*h* because these holes are formed in positions different from an illustrated partially-cutaway sectional position of the apparatus 2*c*.

The core 5*a* also serving as the dies 4 is fixed to the mounting block (not shown) so that the width direction of the core assumes a horizontal. The core 5*a* is adapted to provide setting of the extruded shape 1*a*, with the hollow sectional part 10 placed so that its back surface is turned down in the drawing. The core 5*a* has location holes 5*b* provided in correspondence with the location holes 10*g*, 10*g* and other location holes in the shape 1*a* as shown in FIG. 8.

The press member 7 is so configured as to press the shape 1*a* against the core 5*a* by the pressing apparatus (not shown). The press member 8 is mounted on the table 3 to perform the same operation as that of the press member in the press punching apparatus 2*a* shown in FIG. 5.

The stripper 9 is so configured as to make the downward motion in synchronization with the punch 6, as being slightly advance of the punch 6, into contact with the shape 1*a* slightly earlier than the punching with the punch 6 for pressing the surface to be machined of the shape 1*a* against the core 5*a*.

After setting the shape 1*a* on the core 5*a* of the press punching apparatus 2*c* like the illustrated state, each location hole of the shape 1*a* is placed in alignment with each corresponding location hole 5*b* of the core 5*a* to insert location pins 5*c* into the corresponding location holes 5*b* such that the location pins pass through both the aligned location holes.

Pressing the press member 7 against the corresponding side surface of the shape 1*a* causes the shape 1*a* to be placed under constraint in the direction orthogonal to the two directions, i.e., the longitudinal direction of the shape and the punching direction, and at the same time, the press member 8 is moved upward to the level of the shape 1*a* to press the shape 1*a* against the mounting block (not shown) by the press member 8.

Under this condition, the punch 6 and the stripper 9 are moved downward in synchronization with each other to form the several holes 10*e* and the small-sized hole 10*f* as shown in FIG. 2(*b*) in the front surface of the shape 1*a* by punching. The several holes 10*e* and the small-sized hole 10*f* are formed in positions that are not in alignment with the location pins 5*c*.

It is to be noted that depending on the size, the number and other requirements of the holes and notches to be formed, it is also allowable to effect the punching without placing the shape 1*a* under constraint in any direction, or alternatively, with the shape 1*a* placed under constraint only in the longitudinal direction of the shape or only in the direction orthogonal to the longitudinal direction of the shape and the punching direction.

The casing manufacturing method including the machining process involving use of the press punching apparatus 2*c* is one correspondent form of the method of manufacturing the casing according to claims 14 and 15.

Figure 10:
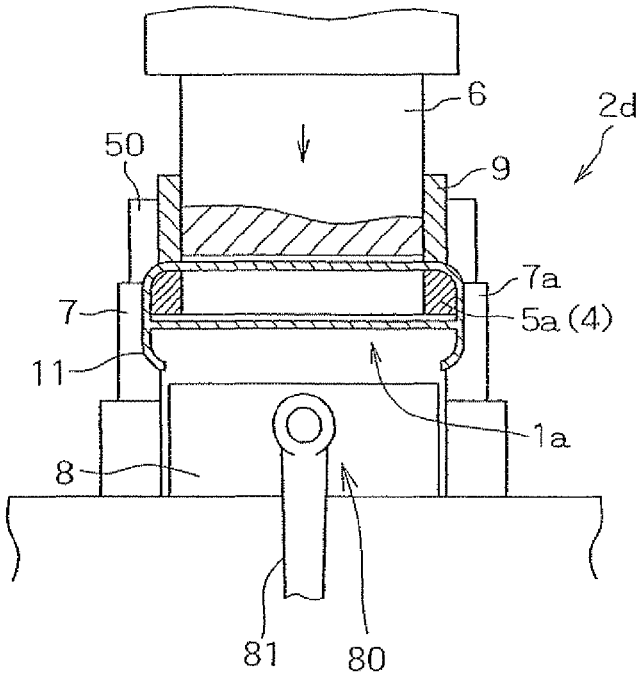
FIG. 10 is a partially cutaway view of schematic front elevation of a press punching apparatus adapted to form a component (display part)-mounting large-sized hole in an area containing a part of the location holes contained in the front surface of the extruded shape in FIG. 7.

After formation of the component-mounting holes 10*e*, 10*f* in the front surface of the shape 1*a* as described the above, the display part-mounting hole 10*d* is formed, using a press punching apparatus 2*d* shown in FIG. 10, in an area adapted to cover the four remaining location holes 10*h* in the front surface of the shape 1*a*.

In the press punching apparatus 2*d* in FIG. 10, the core 5*a* also serving as the dies 4 is adapted to provide setting of the shape 1*a*, with the shape 1*a* placed so that its back surface having the ribs 11, 11 is turned down. The holes of the core 5*a* and the working surface of the punch 6 are slightly larger in size than those of the apparatus 2*a* in FIG. 5. Other configurations are the same as those of the apparatus 2*a* in FIG. 5, so that their description is omitted.

After setting the shape 1*a* on the core 5*a* of the press punching apparatus 2*d* of FIG. 10 like the illustrated state, the press member 8 is moved upward to the level of the shape 1*a* so that the shape 1*a* is pressed against the mounting block 50 by the press member 8 moved forward to the shape 1*a* by a required distance through the operation of the handle 81, causing the shape to be placed under constraint in the longitudinal direction. Moving the punch 6 and the stripper 9 downward allows the press members 7, 7*a* to be moved forward from the opposite sides to the shape 1*a* in synchronization with the punch and the stripper, causing the shape 1*a* to be placed by both the press members under constraint in the direction orthogonal to the longitudinal direction and the punching direction. At the same time, the front surface of the shape 1*a* is pressed against the core 5*a* by the stripper 9 so that the hole 10*d* is formed in the shape 1*a* by punching with the punch 6 moved downwards at a timing slightly later than the stripper.

It is to be noted that depending on the size, the number and other requirements of the holes and notches to be formed, it is also allowable to effect the punching with the shape 1*a* placed under constraint only in the longitudinal direction of the shape, or only in the direction orthogonal to the longitudinal direction of the shape and the punching direction.

The casing manufacturing method including the machining process involving use of the press punching apparatus 2*d* is one correspondent form of the method of manufacturing the small-sized electronic casing according to claim 13.

The following is one illustration of requirements for machining of the holes and the notches by each press punching apparatus.

Machining rate: 1 m/sec. for a mechanical press, and 0.05 m/sec. for a hydraulic press Clamping force: 3000 to 6000N Driven-up of punch: 4 mm Clearance of tools (Difference in level between the punch and the dies): 0.04 mm (in the case of punching of the holes)

0.04 mm (in the case of shearing of the notches)

In the present invention, in relation to a portion adapted to press the press member with the screw jack-type pressing apparatus, a change to a pressing method based on driving of a hydraulic or air cylinder is possible in consideration of productivity. A mass production process gives a preference to this type of pressing method.

According to the small-sized electronic casing of the above embodiment, use is made of the extruded shape 1*a* having the hollow sectional part 10, and the extruded shape 1*a* has the component-mounting holes and notches, providing the casing that has a smaller thickness, is excellent in formability, design properties and electromagnetic wave shielding efficiency, and provides a higher degree of freedom in selection of forms.

This casing ensures a sufficient strength even if its maximum thickness portion has a thickness of 1 mm or less (or 0.4 mm or more).

According to the method of manufacturing the small-sized electronic casing of the above embodiment, after cutting the aluminum alloy extruded shape having the hollow sectional part 10 to the prescribed length, the component-mounting holes and notches are formed in the cut extruded shape 1*a* only by press punching, permitting the productivity and the dimensional precision of the casing having excellent features as described the above to be improved. Further, the press punching in the above embodiment is adaptable to provide positional alignment of higher precision, and also requires a smaller punching clearance, so that a burr hardly occurs. The finishing such as trimming, while being supposed to be applicable to adjustment of the sectional form of the holes, is not required in particular.

Further, a variation in straightness of the surface to be press-punched before and after press punching may be limited to 0.10 mm or less per 40 mm in the rectilinear part. Thus, the press-punched small-sized electronic casing may provide a skeleton dimensional precision as much as 0.30 mm or less per 40 mm. Use of the shape made of the highly precise extruded material A enables the dimensional precision of 0.25 mm or less per 40 mm to be realized as a preferable range, and besides, 0.20 mm or less as the most preferable range. The dimensional precision remains unchanged even after the finishing so far as some measures are taken at the time of the finishing.

Figure 11:
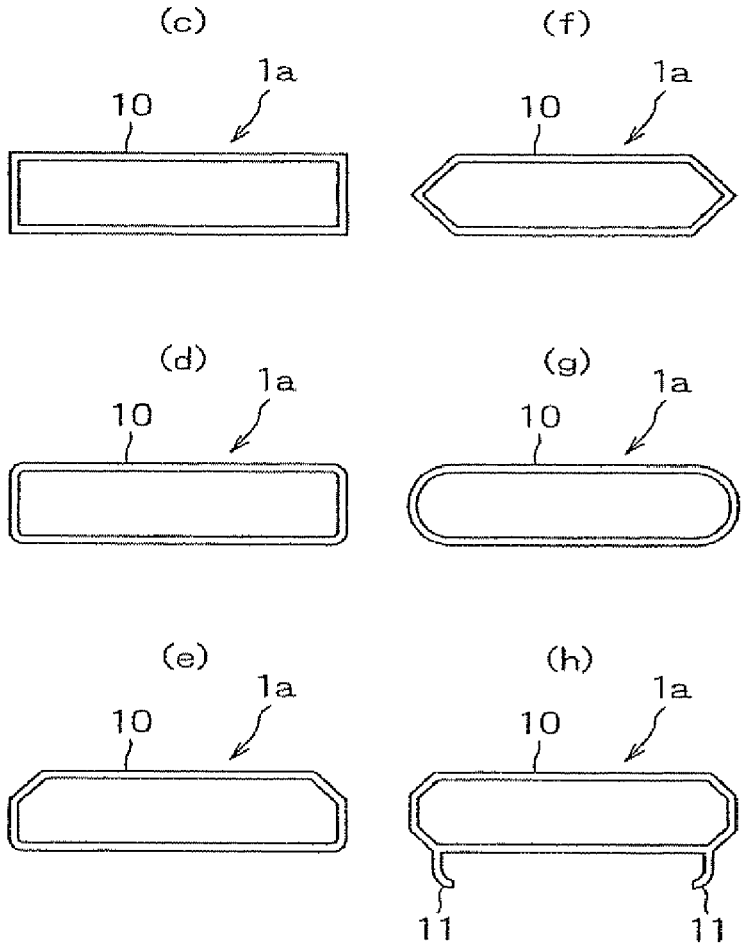
FIG. 11 shows different types of extruded shape used for a mobile communication apparatus casing according to the present invention, in which FIGS. 11(*c*), (*d*), (*e*), (*f*), (*g*) and (*h*) are end views of the different types of extruded shape, respectively.

While the sectional form of the extruded shape 1*a* is designed depending on an electronic apparatus design, the extruded shape, when used for the mobile phone casing, preferably requires that the hollow sectional part 10 be in a wholly flat form such as the flat forms including the forms as shown in FIGS. 11(*c*) to 11(*d*). However, the hollow sectional part is not limited in form to flat, and it is also allowable to use the hollow sectional part having an arbitrary sectional form, provided that the hollow sectional part has a section in a hollow form, and takes the form adaptable to provide the positional alignment at the time of punching.

As shown in the above embodiment and FIG. 11(*h*), the hollow sectional part 10 may have the rib 11 at one or opposite sides of one or opposite surfaces. Further, it is also allowable to form a different rib between the opposite ribs, or alternatively, at the inside of the hollow sectional part 10.

Further, the hollow sectional part 10 may have, therein, partition walls to divide the whole hollow into several hollow parts within limits not injurious to formability and component mounting performance.

While the above embodiment has been described as related to the integrated casing, it is to be understood that when the casing is of a type having more than one casing unit like a transmitting-side casing and a receiving-side casing contained in a foldable-type or sliding-type mobile phone, the above embodiment is applicable to one or both of the casing units. Further, the present invention is also applicable to a case where a different aluminum alloy extruded shape etc. is combined with the casing of the present invention to form the whole casing, so far as this casing is contained in the main part in the whole casing.

The invention claimed is:

1. A method of manufacturing a small-sized electronic casing, the method comprising:

extruding an aluminum alloy to form an extruded shape of a prescribed length, the extruded shape including a flat and hollow section having spaced, opposing flat side walls defining a central hollow, one of the flat side walls having an exterior surface extending across the width of the extruded shape, with ribs extending along opposing edges of the one flat side wall and extending outwardly, curving in a circular arc, from the respective opposing edges, toward each other, to free tip ends facing each other; and press punching component-mounting notches in the ribs by inserting a core, serving as a die, into the hollow section of the extruded shape, in contact with the inner surface of the hollow section; and wherein the extruded shape is constrained in a longitudinal direction by pressing the extruded shape against the core with a press member from one direction orthogonal to the longitudinal direction of the extruded shape and to a punching direction.

2. A method of manufacturing a small-sized electronic casing, the method comprising:

extruding an aluminum alloy to form an extruded shape of a prescribed length, the extruded shape including a flat and hollow section having spaced, opposing flat side walls defining a central hollow, one of the flat side walls having an exterior surface extending across the width of the extruded shape, with ribs extending along opposing edges of the one flat side wall and extending outwardly, curving in a circular arc, from the respective opposing edges, toward each other, to free tip ends facing each other; and press punching all component-mounting holes and/or notches in the extruded shape by inserting a core, serving as a die, into the hollow section of the extruded shape, in contact with the inner surface of the hollow section; and wherein the extruded shape is constrained in a longitudinal direction by pressing the extruded shape against the core with a press member from one direction orthogonal to the longitudinal direction of the extruded shape and to a punching direction.

3. The method of manufacturing the small-sized electronic casing according to claim 1 or 2, further comprising:

straightening the extruded shape before cutting the extruded shape to the prescribed length.

4. The method of manufacturing the small-sized electronic casing according to claim 1 or 2, wherein:

the core is inserted into the extruded shape after formation of more than one location hole in a surface of the extruded shape to be machined; and after aligning the extruded shape with location pins respectively inserted into both location holes in the extruded shape and location holes in the core.

* * * * *